US006878059B2

(12) United States Patent
Boeru

(10) Patent No.: US 6,878,059 B2
(45) Date of Patent: Apr. 12, 2005

(54) CUBE INSERTION GAME

(76) Inventor: Ioan Boeru, 5918 Clarewood Dr., Houston, TX (US) 77081

( * ) Notice: Subject to any disclaimer, the term of this patent is extended or adjusted under 35 U.S.C. 154(b) by 295 days.

(21) Appl. No.: 10/154,882

(22) Filed: May 24, 2002

(65) Prior Publication Data

US 2002/0175472 A1 Nov. 28, 2002

Related U.S. Application Data

(60) Provisional application No. 60/293,712, filed on May 25, 2001.

(51) Int. Cl.[7] ..... A63F 13/00; A63F 9/24

(52) U.S. Cl. ..... 463/9; 273/113; 273/160; 273/244

(58) Field of Search ..... 463/9, 1, 16–44; 273/113, 160, 244, 153 S, 434

(56) References Cited

U.S. PATENT DOCUMENTS 4,796,894 A * 1/1989 Smith ..... 273/244
4,809,980 A * 3/1989 Bertrand ..... 273/157 R
4,861,036 A * 8/1989 Watanabe ..... 273/113
4,889,340 A * 12/1989 Greene ..... 273/153 S
5,312,113 A * 5/1994 Ta-Hsien et al. ..... 463/9
5,344,147 A * 9/1994 Lee ..... 273/153 S
5,393,063 A * 2/1995 Ichimaru ..... 273/160

* cited by examiner

*Primary Examiner*—Xuan M. Thai
*Assistant Examiner*—Robert Mendoza
(74) *Attorney, Agent, or Firm*—Jeffrey M. Davis

(57) ABSTRACT

A game comprises a frame and 82 cubical playing pieces, or playing cubes, 81 of which cubes are removably retained in the frame. For playing purposes, the playing cubes are divided into 3 groups: 27 scoring cubes, 54 blank cubes, and 1 pilot cube. During play cubes are inserted into the frame, forcing another cube to be ejected from the opposite side of the frame. A score is tallied for a player when a scoring cube is ejected from the frame.

30 Claims, 21 Drawing Sheets

START 0°

ROTATED 10°

ROTATED 20°

ROTATED 30°

ROTATED 40°

ROTATED 50°

ROTATED 80°

ROTATED 60°

ROTATED 90°

ROTATED 70°

FIG. 14

```
Module2 - 1

Sub Macro1()
'
' Macro1 Macro
' Macro recorded 9/1/97 by Ioan Boeru
'

'
    Range("AQ23").Select
    Selection.Copy
    Range("AU19").Select
    Selection.PasteSpecial Paste:=xlValues, Operation:=xlNone, SkipBlanks:= _
        False, Transpose:=False
    Range("AU19").Select
    Application.CutCopyMode = False
    Selection.Copy
    Range("L28").Select
    Selection.PasteSpecial Paste:=xlValues, Operation:=xlAdd, SkipBlanks:= _
        False, Transpose:=False
    Range("AK29").Select
    Application.CutCopyMode = False
    Selection.Copy
    Range("AQ23").Select
    Selection.PasteSpecial Paste:=xlValues, Operation:=xlNone, SkipBlanks:= _
        False, Transpose:=False
    Range("AE35").Select
    Application.CutCopyMode = False
    Selection.Copy
    Range("AK29").Select
    Selection.PasteSpecial Paste:=xlValues, Operation:=xlNone, SkipBlanks:= _
        False, Transpose:=False
    Range("Y41").Select
    Application.CutCopyMode = False
    Selection.Copy
    Range("AE35").Select
    Selection.PasteSpecial Paste:=xlValues, Operation:=xlNone, SkipBlanks:= _
        False, Transpose:=False
    Range("S47").Select
    Application.CutCopyMode = False
    Selection.Copy
    Range("Y41").Select
    Selection.PasteSpecial Paste:=xlValues, Operation:=xlNone, SkipBlanks:= _
        False, Transpose:=False
    Range("R46").Select
    Application.CutCopyMode = False
    Selection.Copy
    Range("S47").Select
    Selection.PasteSpecial Paste:=xlValues, Operation:=xlNone, SkipBlanks:= _
        False, Transpose:=False
End Sub
```

FIG. 15

```
Module5 - 1

Sub Macro19()
'
' Macro19 Macro
' Macro recorded 12/18/97 by Ioan Boeru
'

'
    Range("AQ23").Select
    Selection.Copy
    Range("AU19").Select
    Selection.PasteSpecial Paste:=xlValues, Operation:=xlNone, SkipBlanks:= _
        False, Transpose:=False
    Application.CutCopyMode = False
    Selection.Copy
    Range("BK28").Select
    Selection.PasteSpecial Paste:=xlValues, Operation:=xlAdd, SkipBlanks:= _
        False, Transpose:=False
    Range("AK29").Select
    Application.CutCopyMode = False
    Selection.Copy
    Range("AQ23").Select
    Selection.PasteSpecial Paste:=xlValues, Operation:=xlNone, SkipBlanks:= _
        False, Transpose:=False
    Range("AE35").Select
    Application.CutCopyMode = False
    Selection.Copy
    Range("AK29").Select
    Selection.PasteSpecial Paste:=xlValues, Operation:=xlNone, SkipBlanks:= _
        False, Transpose:=False
    Range("Y41").Select
    Application.CutCopyMode = False
    Selection.Copy
    Range("AE35").Select
    Selection.PasteSpecial Paste:=xlValues, Operation:=xlNone, SkipBlanks:= _
        False, Transpose:=False
    Range("S47").Select
    Application.CutCopyMode = False
    Selection.Copy
    Range("Y41").Select
    Selection.PasteSpecial Paste:=xlValues, Operation:=xlNone, SkipBlanks:= _
        False, Transpose:=False
    Range("V50").Select
    Application.CutCopyMode = False
    Selection.Copy
    Range("S47").Select
    Selection.PasteSpecial Paste:=xlValues, Operation:=xlNone, SkipBlanks:= _
        False, Transpose:=False
End Sub
```

CUBE INSERTION GAME

This application is based on U.S. Provisional Application No. 60/293,712, which was filed on May 25, 2001.

BACKGROUND OF THE INVENTION

Numerous mechanical games and puzzles have been devised which comprise a basic 3-dimensional cubic structure. Many of these games, like the one shown in U.S. Pat. No. 5,613,681, are essentially 3-dimensional adaptations of the popular 2-dimensional children's game known as "Tic-Tac-Toe" or "Naughts and Crosses". The '681 patent discloses a game comprising a frame for resiliently retaining up to 27 spherical balls in a 3×3×3 array. The balls are inserted into the frame, and the "score" of the game is dependent on the arrangement of the balls within the frame. If any of the balls are ejected from the frame during game play, they are not considered in the scoring.

The game of the present invention comprises a frame which resiliently retains a plurality of game pieces in a 3-dimensional array. The present invention is distinguished from the prior art in that the scoring of the game is not dependent on the arrangement of the pieces within the frame, but rather on which pieces are ejected from the frame on each turn.

SUMMARY OF THE INVENTION

The physical embodiment of the game comprises a frame and 82 cubical playing pieces, or playing cubes, removably retained in the frame. All the cubes are the same length per side, this length being defined as the unit length, and preferably being approximately 2 inches. Preferably the cubes are constructed of plastic or any other suitably rigid, durable, lightweight material. For playing purposes, the playing cubes are divided into 3 groups: 27 scoring cubes, 54 blank cubes, and 1 pilot cube. During play, as will be described below, cubes are inserted into the frame, forcing another cube to be ejected from the opposite side of the cube. The cube edges are preferably rounded or chamfered to facilitate movement relative to each other and to the frame.

Each of the 27 scoring cubes include removable marking means for marking a single side of the cube. Preferably the marking means comprises a circular recess in the side of the cube, and color-coded circular button which is removably installable in the recess. The blank and pilot cubes are essentially identical to the scoring cubes, except that the there is no need for marking means on the blank cubes.

The frame comprises 12 elongate legs rigidly attached to each other to define the edges of a frame cube approximately 5 units in length per side. The cross section of each leg is a square approximately 1 unit in length per side. Therefore, there are 7 different volumes defined within the frame for receiving the playing cubes. The center volume in the center of the frame measures 3×3×3 units. The 6 side volumes each measure 3×3×1 units, and each side volume is disposed on one side of the frame cube between the 4 legs forming that side. The frame also comprises retention means for removably retaining the playing cubes within the frame.

Before assembling the cubes in the frame for play, a color-coded button is inserted into one recess on each of the 27 scoring cubes. The playing cubes are loaded into the frame such that the side volumes of the frame contain only blank cubes, and the center volume contains the scoring cubes. Therefore, the blank cubes are divided into 6 separate 3×3 side arrays. The scoring cubes define a 3×3×3 center array, and are arranged such that the marked face of each scoring cube faces ONLY another scoring cube and NOT a blank cube.

In the most basic version of the game, two players take turns inserting a cube into one of the face arrays in the frame. A cube is thereby ejected from the corresponding position in the opposite face array, and all the cubes in that position along that axis are displaces one position. The first player begins by inserted the pilot cube into the center position in any face array. The ejected cube now becomes the new pilot cube. The second player inserts the new pilot cube into the center position of any face array perpendicular to the first face array. After these first two moves, the players may insert the pilot cube into any position in any face array.

When a scoring cube is ejected during a player's turn, that player removes the color-coded button from the scoring cube, and is awarded the value of the button. For the simplest game all the buttons are given a value of 1 point. Once the button has been removed from the scoring cube, the next player uses that cube as the pilot, and the game continues. A player wins the game when he has accumulated a majority of the available points (in this case, 14).

BRIEF DESCRIPTION OF THE DRAWINGS

FIGS. 14 and 15 show listings of two representative macros used in the spreadsheet model of FIG. 12.

DETAILED DESCRIPTION OF THE INVENTION

Physical Construction

Figure 1:
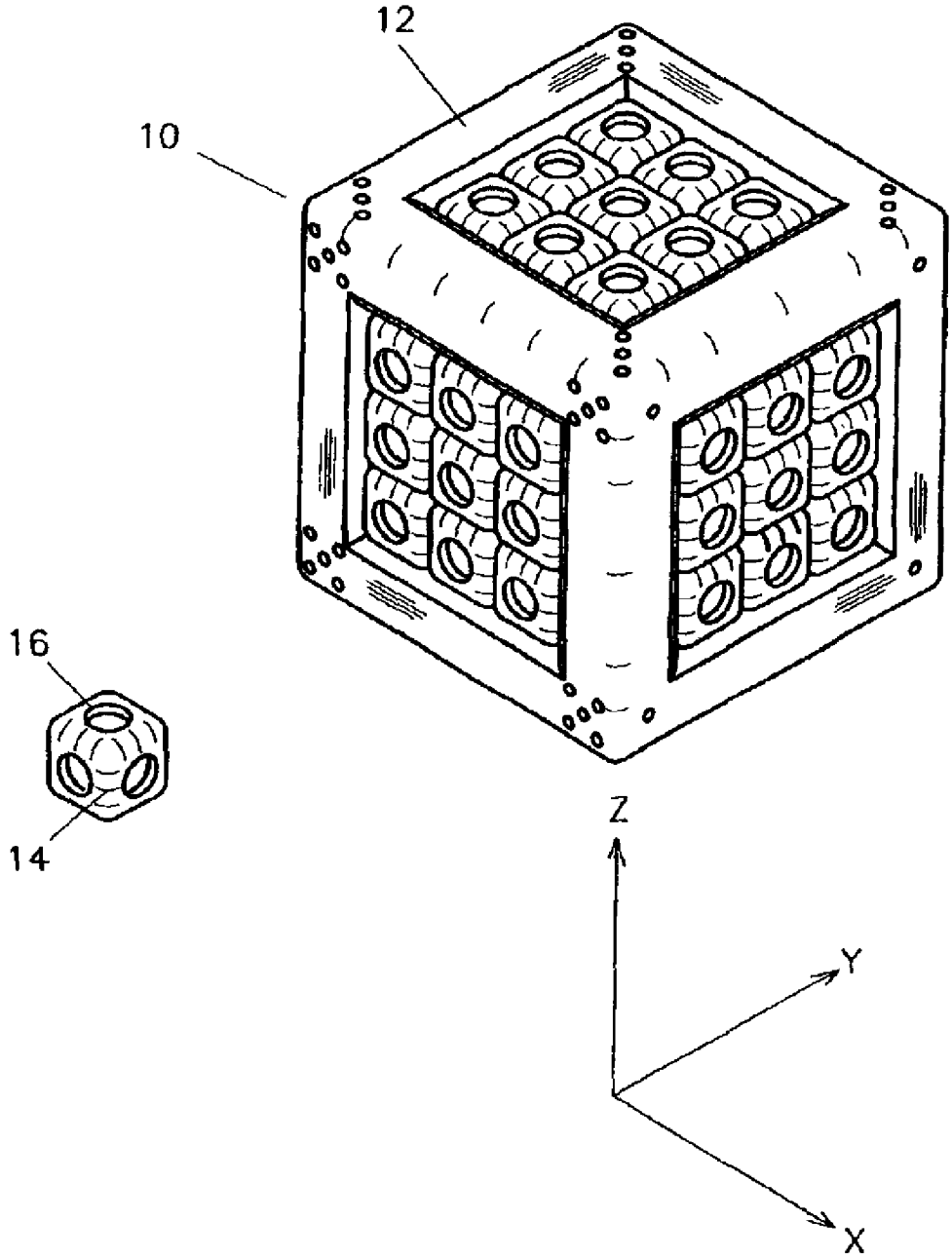
FIG. 1 shows an isometric view of the preferred embodiment game assembled and ready for play.

Referring to FIG. 1, the game 10 comprises a frame 12 and 82 cubical playing pieces, or playing cubes such as 14, removably retained in the frame. All the cubes are approximately the same length per side, this length being defined as the unit length, and preferably being approximately two inches. Preferably the cubes are constructed of plastic or any other suitably rigid, durable, lightweight material. For playing purposes, the playing cubes are divided into three groups: 27 scoring cubes, 54 blank cubes, and one pilot cube. During play, as will be described below, cubes are inserted into the frame, forcing another cube to be ejected from the opposite side of the cube. The cube edges are preferably rounded or chamfered, as shown generally at 16, to facilitate movement relative to each other and to the frame. In other embodiments the playing pieces could have any shape.

Figure 2:
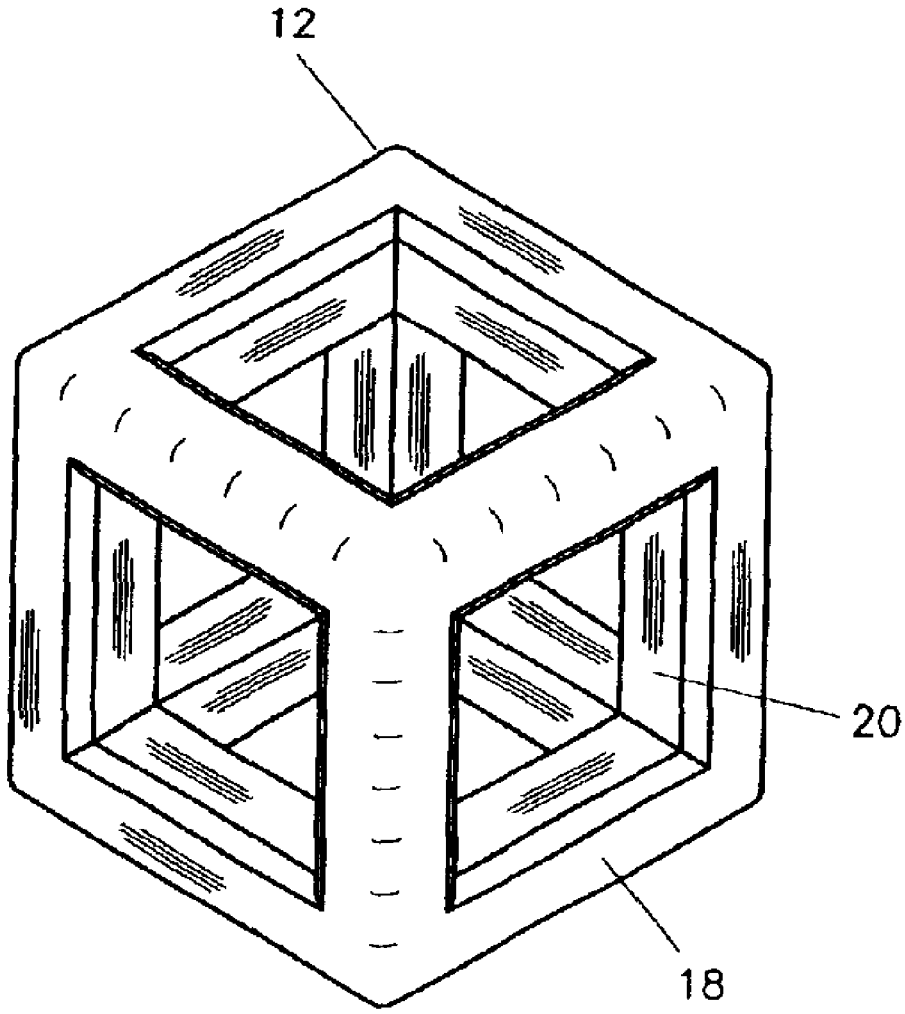
FIG. 2 shows an isometric view of the frame portion of the preferred embodiment game.

Referring to FIG. 2, the frame 12 comprises twelve elongate legs such as 18 rigidly attached to each other to define the edges of a frame cube approximately 5 units in length per side. The cross section of each leg is a square approximately 1 unit in length per side. Therefore, there are 7 different volumes defined within the frame for receiving the playing cubes. The center volume in the center of the frame measures 3×3×3 units. The six side volumes such as 20 each measure 3×3×1 units, and each side volume is disposed on one side of the frame cube between the four legs forming that side. Referring to FIG. 1, the six sides of the frame may be numbered in a manner similar to a gaming die. Sides one and six are opposite each other and are perpendicular to the X-axis of the frame. Sides two and five are opposite each other and are perpendicular to the Y-axis of the frame. Sides three and four are opposite each other and are perpendicular to the Z-axis of the frame.

Figure 3:
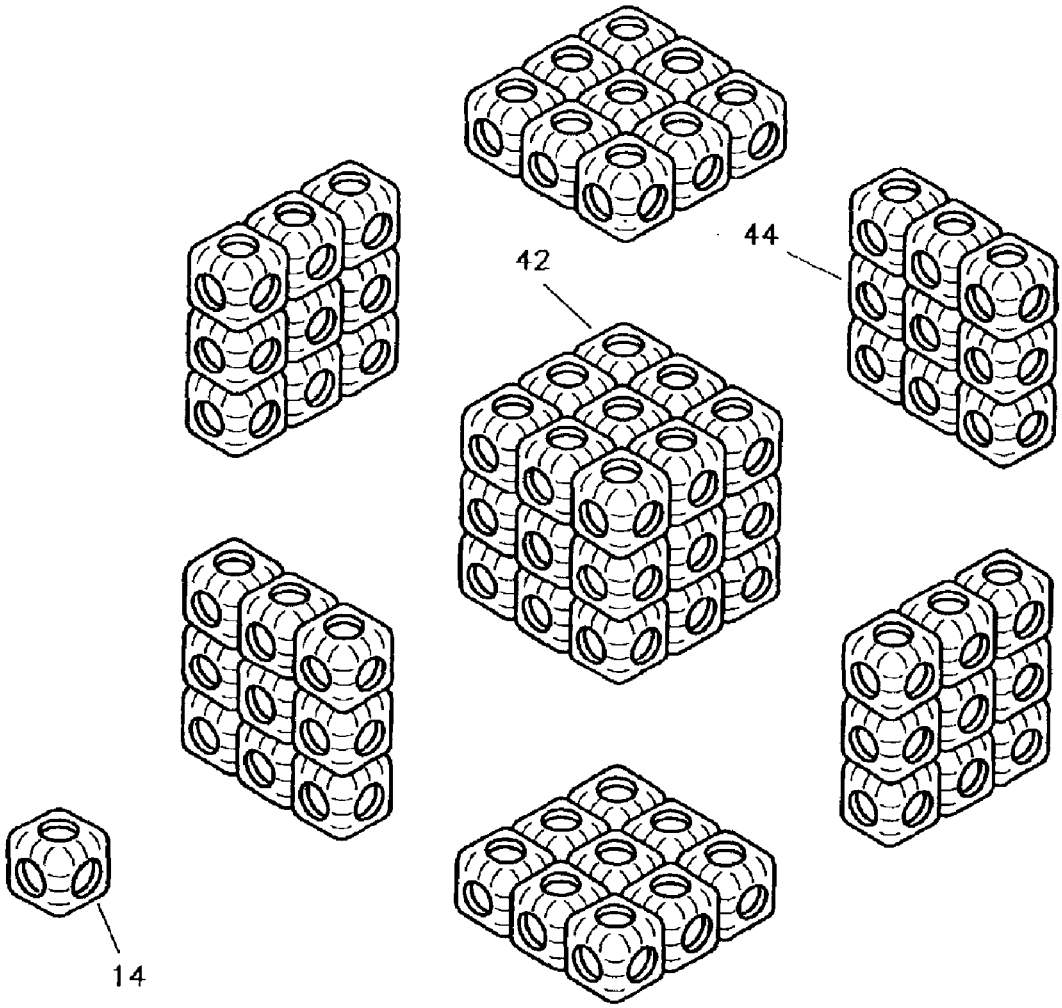
FIG. 3 shows an exploded isometric view of the various cube arrays in the preferred embodiment game.

Referring to FIG. 3, the playing cubes are shown in an exploded view. The 27 scoring cubes are arranged in a 3×3×3 center array 42. During game play this center array is disposed in the center volume defined by the frame. The blank cubes are arranged in six side arrays or face arrays such as 44. During game play each side array is disposed in one of the side volumes 20 defined by the frame.

Figure 4A:
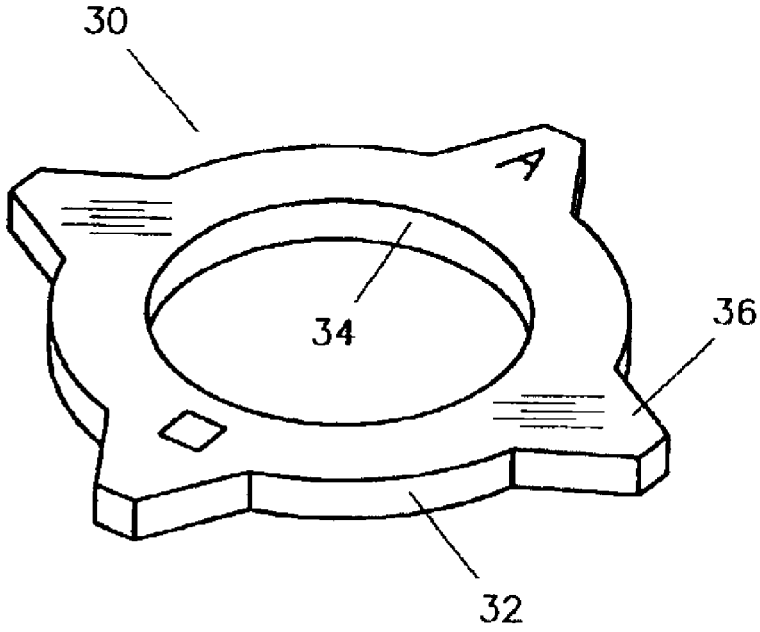
FIGS. 4*a* and 4*b* show isometric views of scoring buttons having four and three teeth, respectively.
Figure 5:
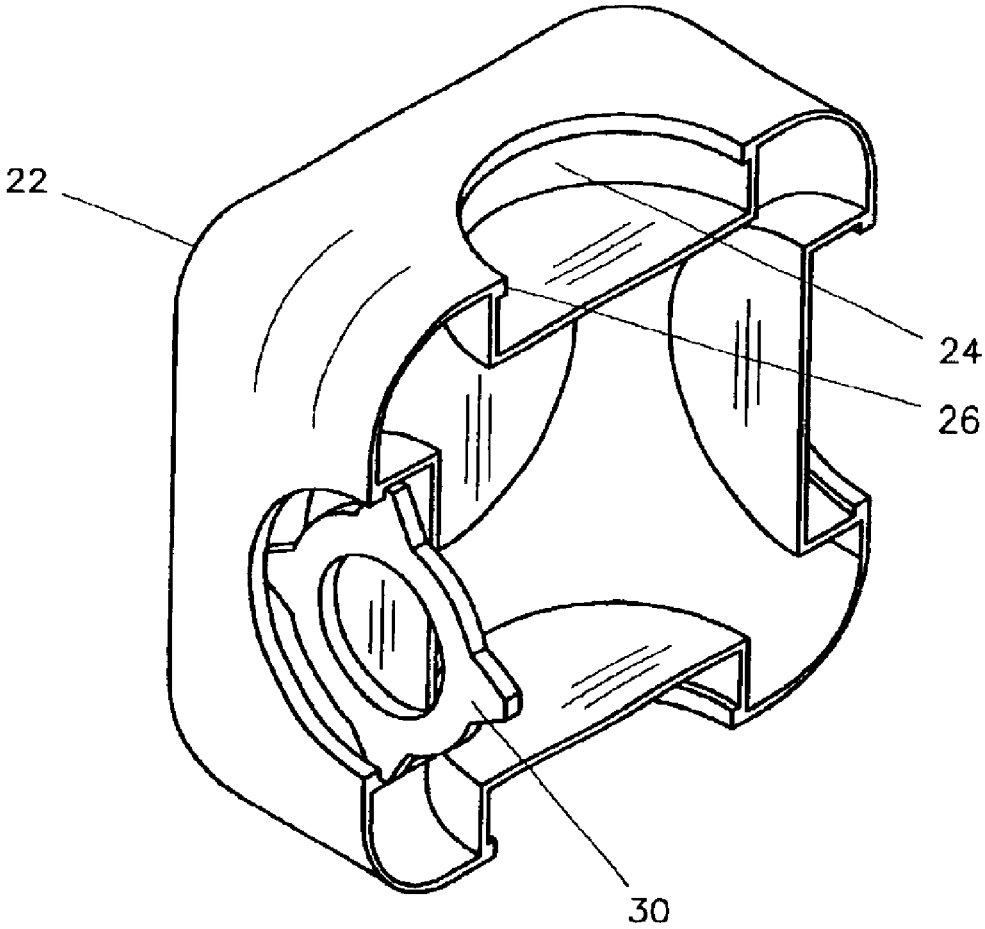
FIG. 5 shows an isometric cutaway view of a preferred embodiment scoring cube with a scoring button installed.

Each of the 27 scoring cubes includes removable marking means for marking a single side of the cube. Referring to FIG. 5, preferably the marking means comprises a circular recess 24 in the side of the cube 20. The recess 24 includes an internal lip 26, and a color-coded circular button 30 may be removably installed in the recess 24, and retained by lip 26. Referring to FIG. 4*a*, the preferred embodiment button 30 comprises an annular body 32, a central aperture 34, and a plurality of retaining tabs 36. The button 30 is shown to include four tabs, although in other embodiments the button may include any number of tabs.

Figure 4B:
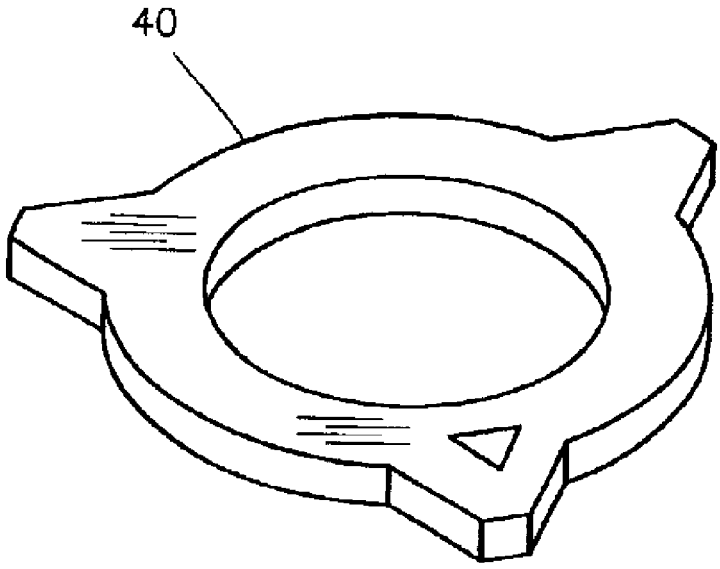
Figure 5A:
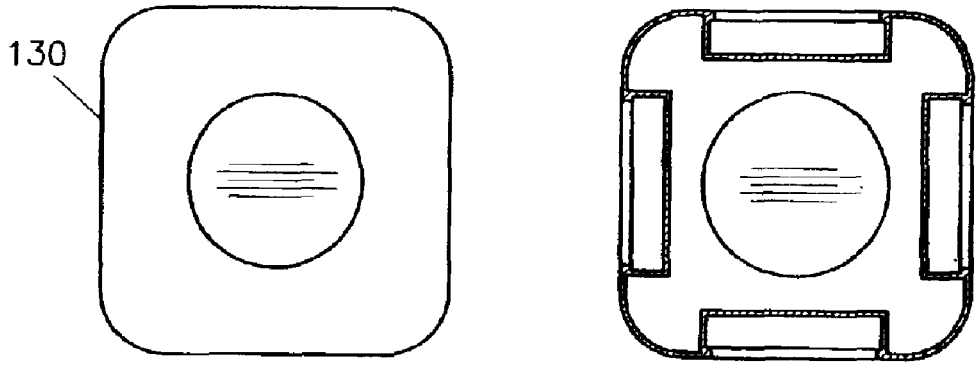
FIG. 5*a* shows a plan and cross-sectional view of a preferred embodiment blank or pilot cube.
Figure 5B:
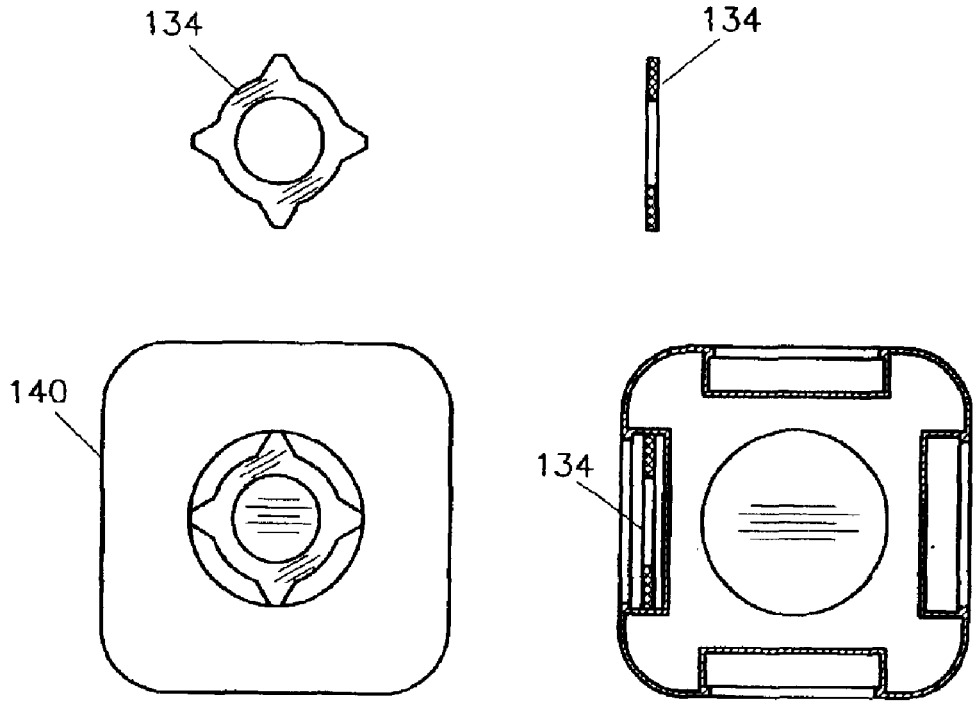
FIG. 5*b* shows a plan and cross-sectional view of a preferred embodiment scoring cube.

Referring to FIG. 4*b*, button 40 includes 3 tabs. The buttons are preferably made of a flexible, compliant material such as foam rubber, which allows the button to be inserted and removed from recess 24 without damage to either the button or the cube. To remove the button 30 from the recess 24, a player may insert a fingertip into the central aperture 34 and pull the button from the recess. To accommodate different modes of play, the buttons may include different and/or additional information, such as alpha-numeric characters, shapes, or other designs. Each scoring cube may be provided with multiple recesses, and preferably each scoring cube is provided with a recess on each of the six sides. The reasons for this preference include ease of play, ease of manufacture, and flexibility in the rules of play, as will be described in more detail below. FIG. 5*b* shows a plan view and a cross-sectional view of a scoring cube 140 with button 134 inserted into one of the recesses.

The blank cubes are essentially identical to the scoring cubes, except that the there is no need for marking means on the blank cubes. For ease of play and ease of manufacture, however, the blank cubes are preferably identical to the scoring cubes, having a recess on each of the six sides. Therefore, the scoring cubes are only distinguishable form the blank cubes when the buttons are installed in the recesses. The pilot cube is also essentially identical to the blank cubes, and is therefore preferably identical to the scoring cubes, having a recess on each of the six sides. FIG. 5*a* shows a plan view and a cross sectional view of pilot or blank cube.

Figure 6:
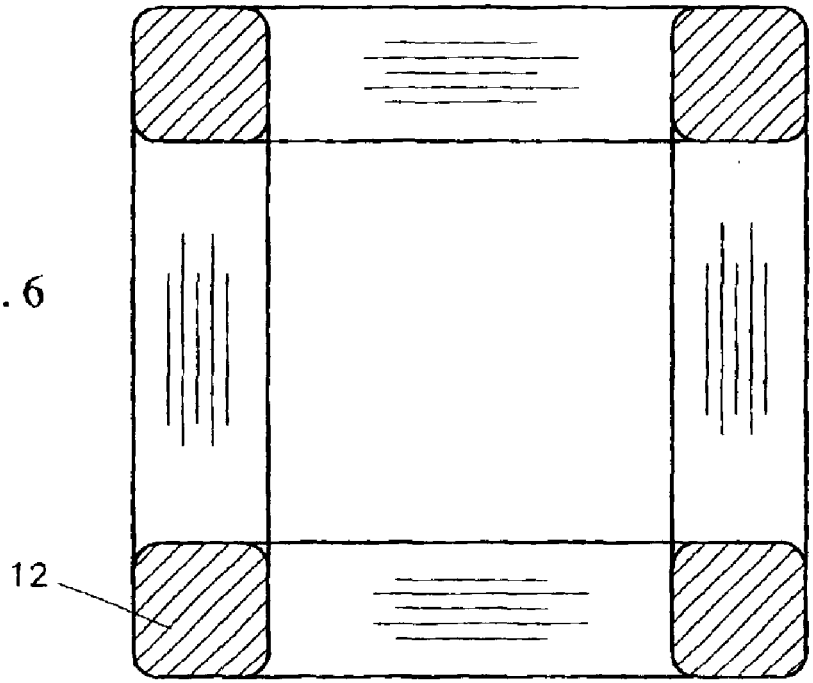
FIG. 6 shows a cross-sectional view of the preferred embodiment frame.
Figure 7:
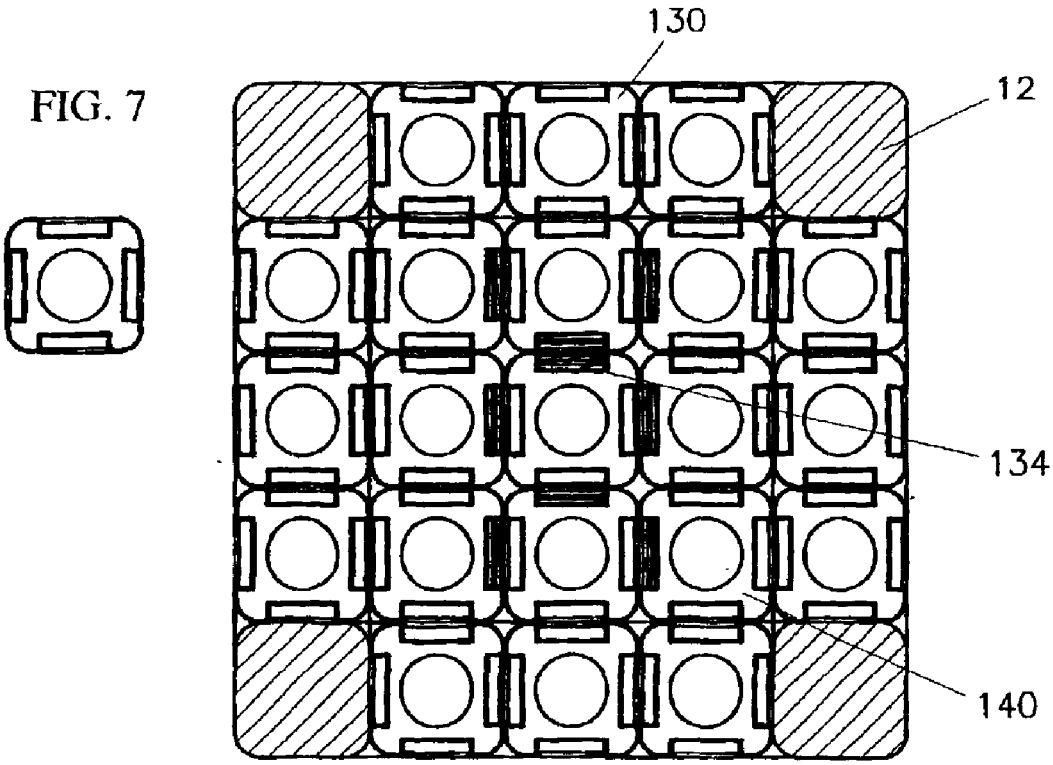
FIG. 7 shows a cross sectional view of the preferred embodiment game assembled for play.
Figure 8:
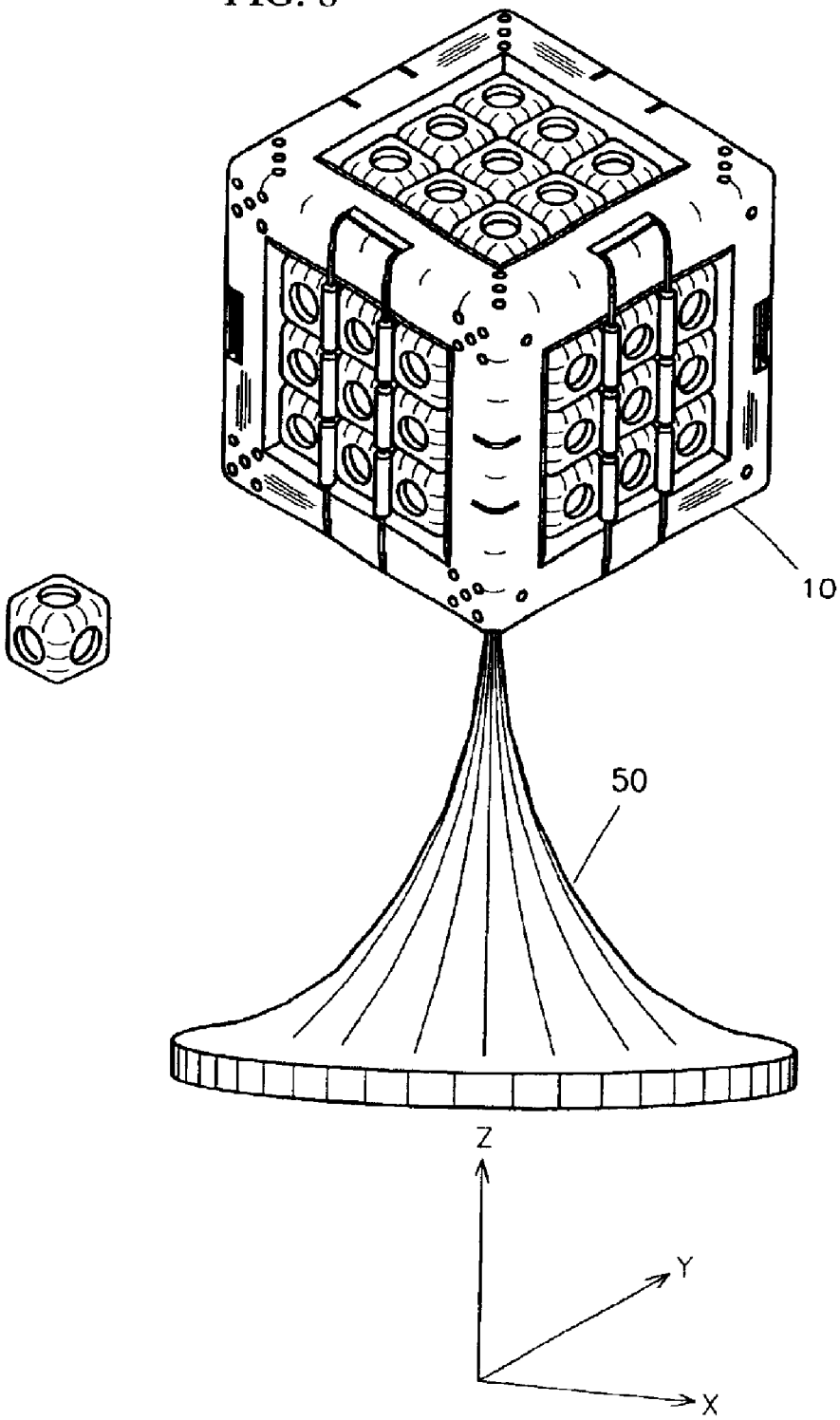
FIG. 8 shows an isometric view of the preferred embodiment game mounted on a stand.

Before assembling the cubes in the frame for play, a color-coded button is inserted into one recess on each of the 27 scoring cubes. The playing cubes are loaded into the frame such that the side volumes of the frame contain only blank cubes, and the center volume contains the scoring cubes. The scoring cubes are arranged such that the marked face of each scoring cube faces ONLY another scoring cube and NOT a blank cube. FIG. 6 shows a cross-sectional view of the frame 12. FIG. 7 shows a cross-sectional view of the game assembled for play. Blank cubes such as 130 are disposed in the side arrays of frame 12. Scoring cubes such as 140 are disposed in the central array. Each scoring cube 140 is provided with button 134. Referring to FIG. 8, the entire game assembly 10 may be rotatably mounted on a stand 50.

Figure 9:
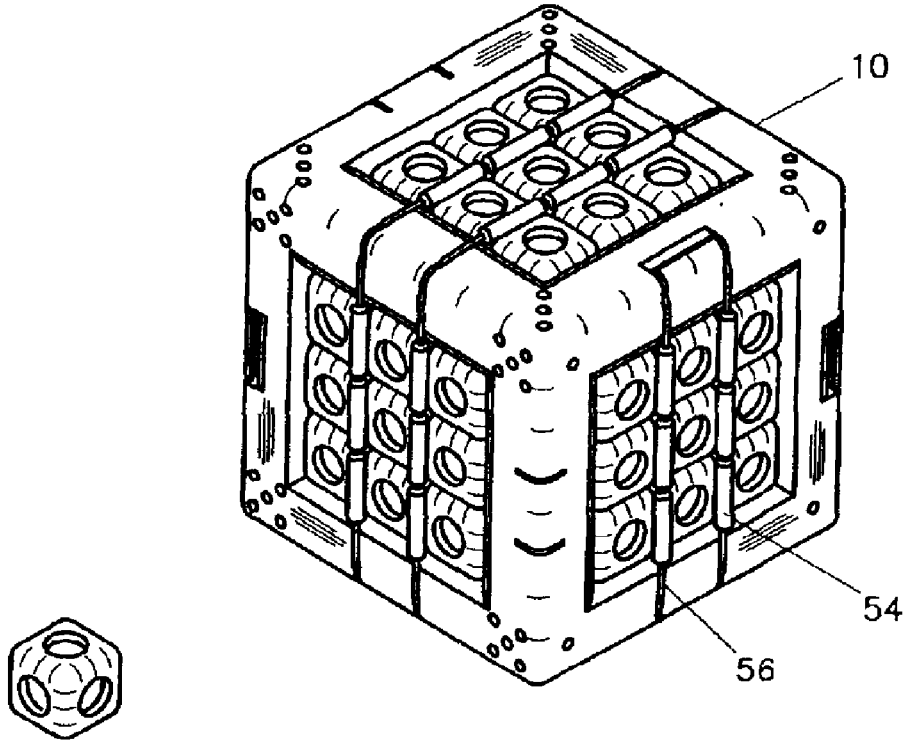
FIG. 9 shows an isometric view of game with the preferred cube retention means.

Referring to FIG. 9, the frame also comprises retention means for removably retaining the playing cubes within the frame. Preferably the retention means comprises a series of thin cylindrical members 54 mounted on an elastic cord 56, and disposed across the outside surface of each face volume. The openings between the members 54 are slightly smaller than the playing cubes. During play, as a cube is inserted into the frame, the cube directly opposite the inserted cube pushes the cylindrical members 54 apart, and the cube is forced through the grid opening and is ejected from the frame. Since the remaining cubes are not being pushed by the inserted cube, they are retained within the frame by the members 54. The elastic cords may be arranged to span one, two, three, or four faces of the frame. Therefore, various combinations of these arrangements may be used to retain cubes from all sides of the game. If the game is to be mounted as in FIG. 8, only the lower three sides of the frame need to be provided with retaining means.

Figure 10A:
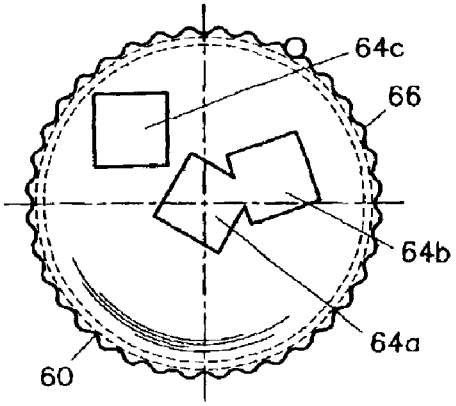
FIGS. 10*a* through 10*k* show plan views of an alternative cube retention means.
Figure 10B:
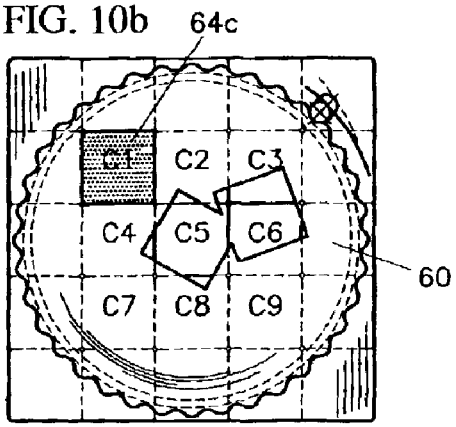
Figure 10C:
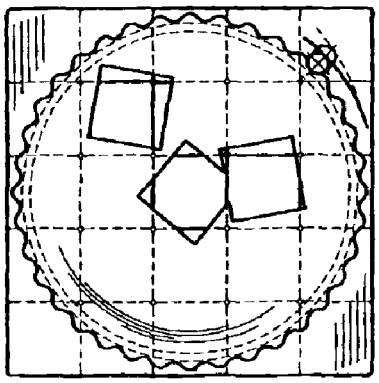
Figure 10D:
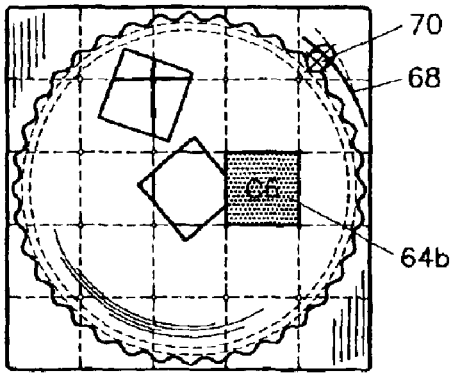
Figure 10E:
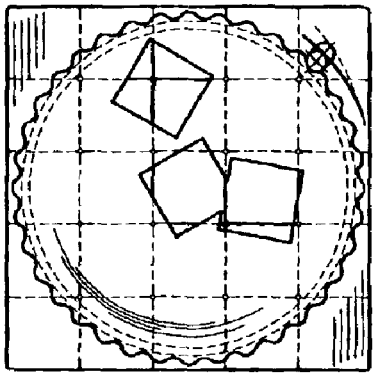
Figure 10F:
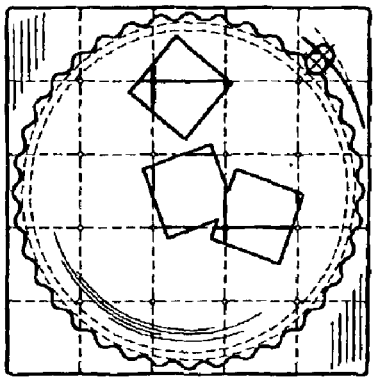
Figure 10G:
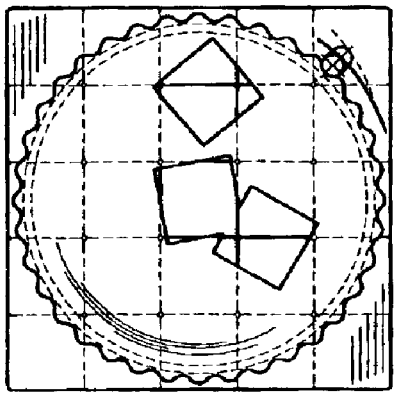
Figure 10J:
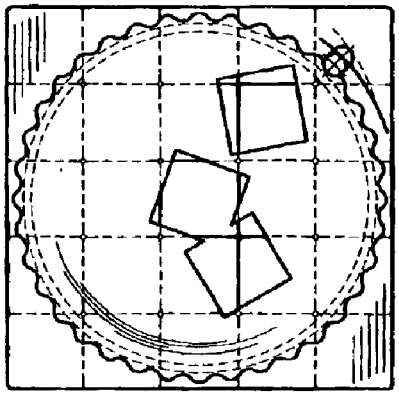
Figure 10H:
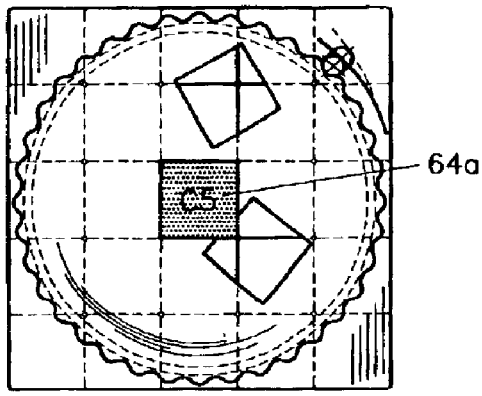
Figure 10K:
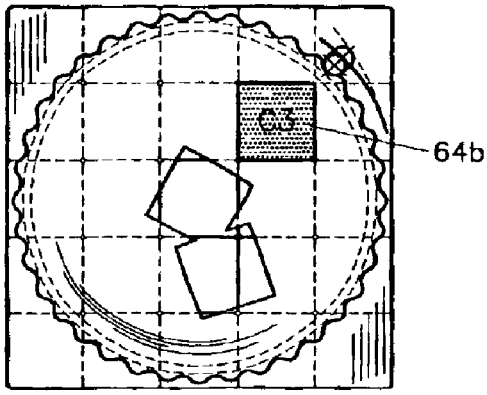
Figure 10I:
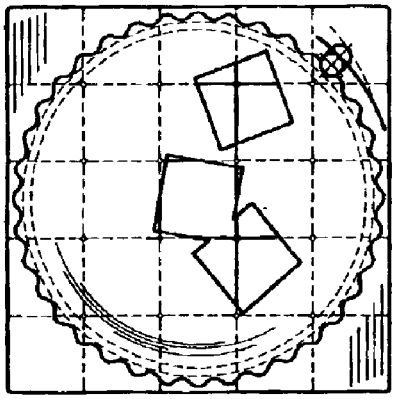

In another embodiment, as shown in FIGS. 10*a* through 10*k*, the retention means comprises a rotatable circular cover 60 mounted over each face of the frame. The cover includes three square openings 64*a*, 64*b*, and 64*c*, which in cooperation allow only one playing cube to pass through the cover at any time. Referring to FIG. 10*a*, when the cover 60 is in a first position representing 0 degrees of rotation, the third opening 64*c* is aligned with the first cube C1 in the side array. After the cover has been rotated through 20 degrees, as shown in FIG. 10*d*, the second opening 64*b* is aligned with cube C6. After the cover has been rotated through 60 degrees, as shown in FIG. 10*h*, the first opening 64*a* is aligned with cube C5. After the cover has been rotated through 90 degrees, as shown in FIG. 10*k*, the third opening 64*c* is aligned with cube C3. It will be understood that as the cover is rotated further, the openings 64*b* and 64*c* will eventually be aligned with each of the remaining cubes in the side array. Referring to FIGS. 10*a* and 10*d*, the cover may be provided with a toothed profile 66 on its outer diameter. The frame may be provided with a detent 70 mounted on a leaf spring 68. The detent engages the teeth 66 to resiliently retain the cover 60 in a particular angular position. The covers on opposite sides of the frame may be geared together through the frame, to provide for synchronous movement of opposing covers. In other embodiments, any suitable means may be employed to removably retain the playing cubes within the frame.

Game Play

Figure 11A:
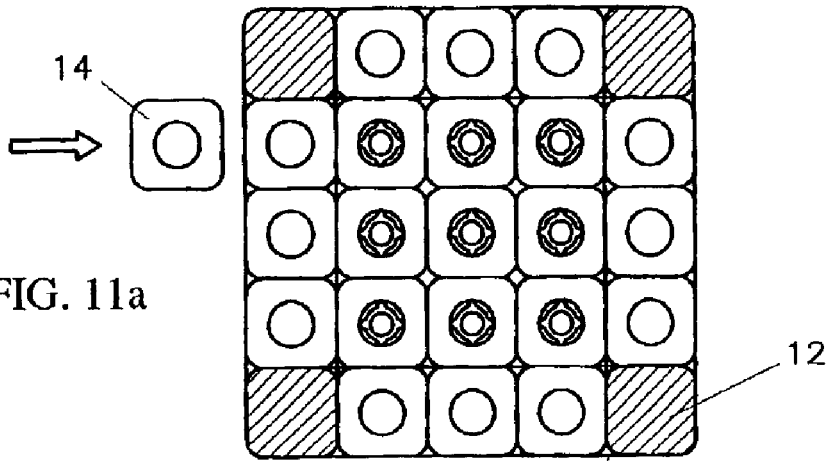
FIGS. 11*a* through 11*c* show a cross-sectional view of the preferred embodiment game as pilot cube is being inserted.
Figure 11B:
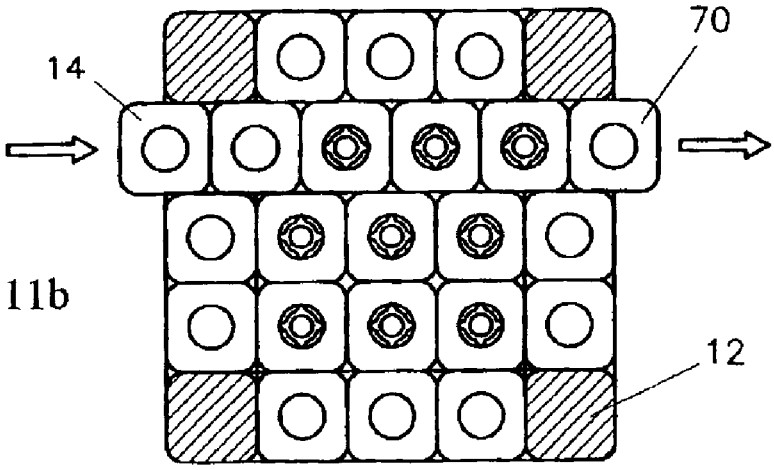
Figure 11C:
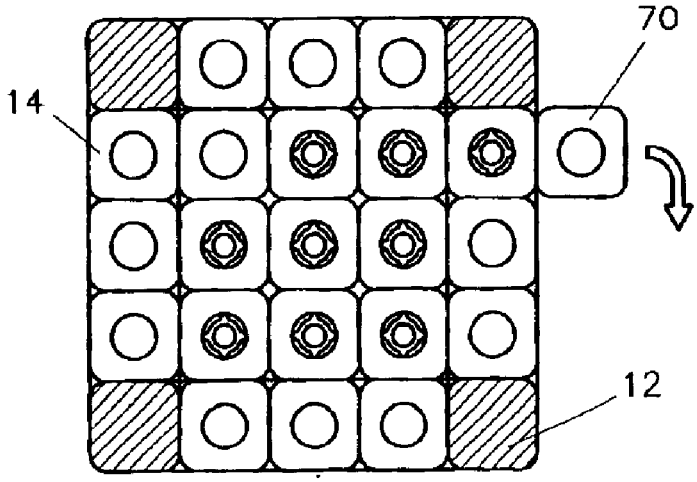

Referring to FIGS. 11*a* through 11*c*, in the most basic version of the game, two players take turns inserting a pilot cube 14 into one of the face arrays in the frame 12. Another cube 70 is thereby ejected from the corresponding position in the opposite face array, and all the cubes in that position along that axis are displaces one position. The first player begins by inserted the pilot cube into the center position in any face array. The ejected cube now becomes the new pilot cube. The second player inserts the new pilot cube into the center position of any face array perpendicular to the first face array. After these first two moves, the players may insert the pilot cube into any position in any face array.

When a scoring cube is ejected during a player's turn, that player removes the color-coded button from the scoring cube, and is awarded the value of the button. For the simplest game all the buttons are given a value of 1 point. Once the button has been removed from the scoring cube, the next player uses that cube as the pilot, and the game continues. A player wins the game when he has accumulated a majority of the available points (in this case, 14).

In other modes of play, the buttons may be given different values, as indicated by different colors, characters, shapes, or designs. Particularly marked buttons may be used to signify special occurrences in the game, such as an extra turn, a loss of turn, a loss of some or all accumulated points, automatic defeat or victory, and many other various special occurrences. In still other modes of play, 2 or more buttons may be installed in each scoring cube.

In still other modes of play, 3 or more players or teams of players may play the game. When the number of players or teams is even or divisible by 3, each player or team may be assigned a particular set of frame faces into which they must insert all their pilot cubes during the game. In another variation, the frame face for each move may be selected at random, such as with a gaming die.

Electronic Versions

Figure 12:
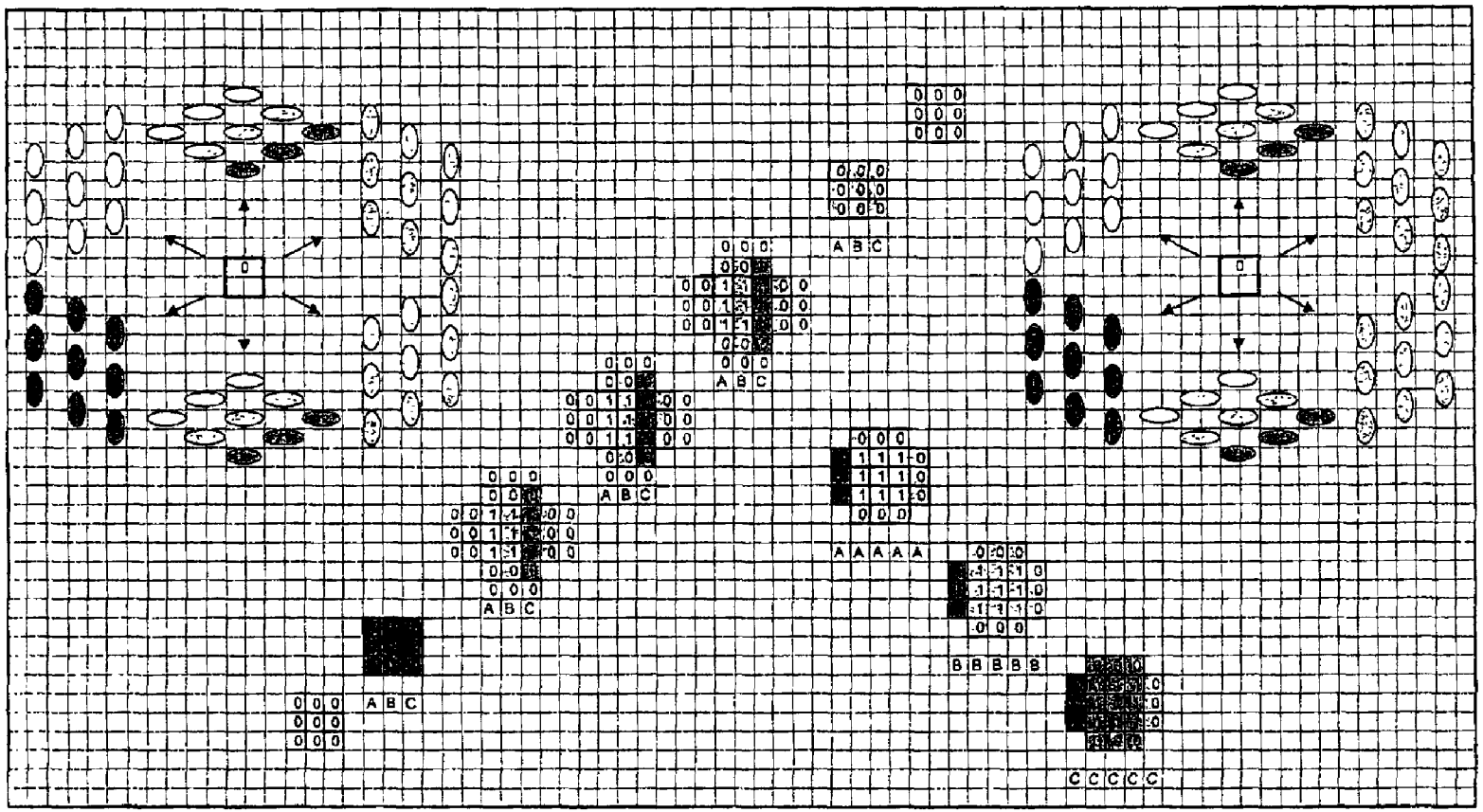
FIG. 12 shows a schematic of the preferred embodiment game modeled on a computer spreadsheet program.
Figure 13:
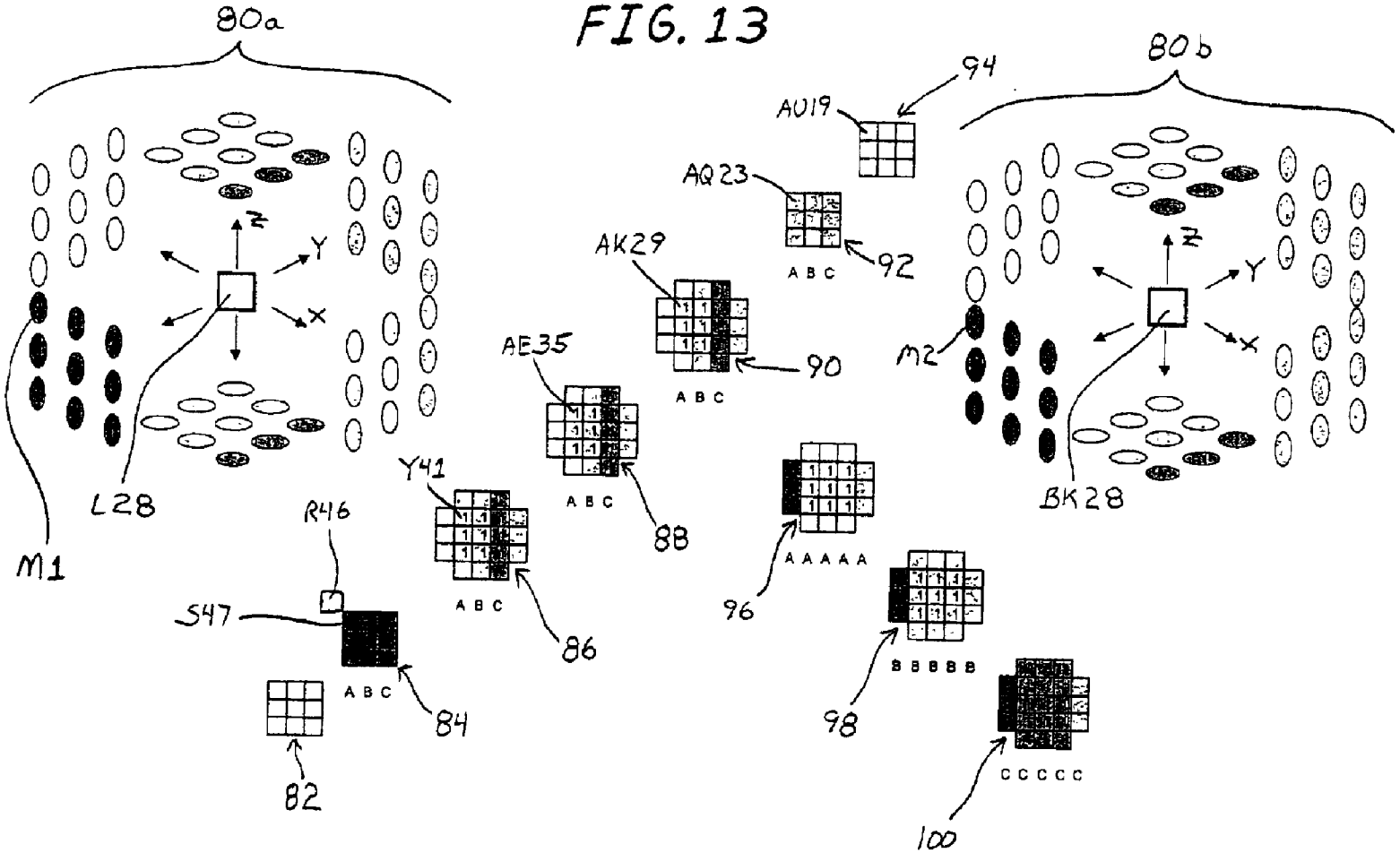
FIG. 13 shows the game of FIG. 12 with the spreadsheet gridlines removed.

The game of the present invention may also be modeled electronically, such as with a computer spreadsheet program. A spreadsheet model of the game is shown schematically in FIG. 12. The same model is shown in FIG. 13 with the spreadsheet gridlines removed. The model includes two 3-dimensional representations of the game playing surfaces, one for each player or team, shown generally as play areas 80*a* and 80*b*. Each play area comprises 6 arrays of 9 ellipses, or pushbuttons, which represent the 6 face arrays in the physical embodiment of the game. Play areas 80*a* and 80*b* also comprise scoring cells L28 and BK28, respectively, which store the players' scores. By clicking or selected one of the pushbuttons with a mouse or other pointing device, a player may initiate a move. Pushing a particular pushbutton in the computer model is equivalent to inserting the pilot cube into the face array location represented by the pushbutton.

The internal configuration of the physical game is modeled as a series of cell arrays in the spreadsheet. Cell arrays 84, 86, 88, 90 and 92 represent successive "slices" through the physical game perpendicular to the Y-axis. Cell arrays 84 and 92 represent opposite face arrays. Cell arrays 86, 88 and 90 each comprise a central area of 9 cells representing a "slice" through the center array, and 4 groups of 3 cells each, representing sections of each of the remaining face arrays. Cell arrays 96, 98 and 100 represent successive slices through the center array perpendicular to the X-axis. Cell arrays 82 and 94 are provided to act as "holding" cells for scoring moves.

Blank cubes are represented by a null or zero value, and scoring cubes are represented by a unit value. The movement of the playing cubes, and more particularly the locations of the scoring cubes, are modeled and tracked by the spreadsheet by moving the values from cell to cell. There are 108 possible moves, which is equal to the number of available pushbuttons. Each move is managed by a macro which moves values from cell to cell according to an algorithm which models the physical games. At the start of the game, all the cells representing the center array are assigned a value of 1. The cells representing the side arrays, as well as holding arrays 82 and 94, and the 2 scoring cells, are initially set to zero. Referring to FIG. 13 and the macro shown in FIG. 14, a sample move is described for Player 1 (playing on the left play area).

Player 1 selects pushbutton M1 on play area 80*a*. The value of AQ23 is moved to AU19. The value of AU19 is added to the current value of scoring cell L28, such that L28 represents a cumulative score for Player 1. In this instance, no score was achieved on this move. The value of AK29 is moved to AQ23, the value of AE35 is moved to AK29, the value of Y41 is moved to AK29, and the value of S47 is moved to Y41. The last step in the macro is to assign S47 a null value, since the macro is modeling insertion of the non-scoring pilot cube into the physical game. To accomplish this, the value of R46 (always null) is moved to S47. Note that AQ23, AK29, and AE35 now all have a value of 1, and Y41 and R46 have a value of zero.

Referring now to FIG. 13 and the macro shown in FIG. 15, Player 2 selects pushbutton M2 on play area 80*b*. Note that this button represents the same move as pushbutton M1, except that any score goes to Player 2. The macro proceeds in similar fashion to that described above. Note, however, that since AQ23 has a value of 1, this value is moved to AU19 and then added to the current value of BK28. Therefore, Player 2 receives a score of 1 for this move. Similar macros manage moves initiated by the other pushbuttons, and calculate the new configuration of the cells, including the score, after each move.

Figure 16:
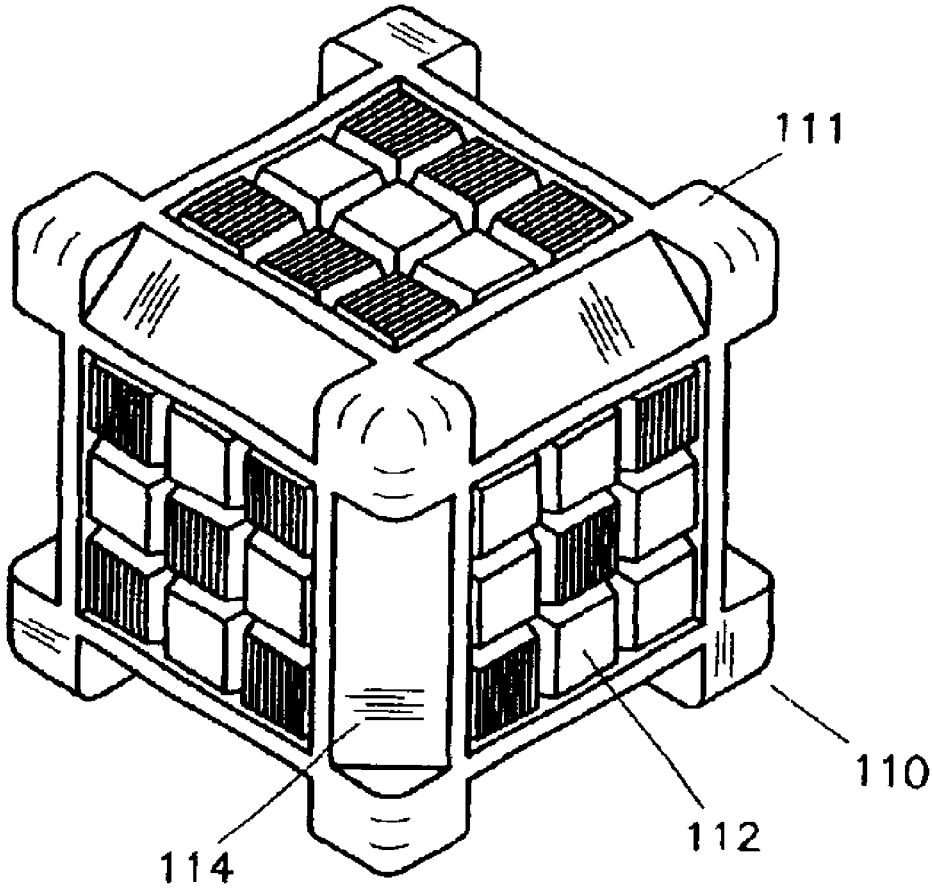
FIG. 16 shows an isometric view of an electronic version of the game having a cube configuration with input buttons on each face.

The algorithms used in the above spreadsheet based game may also be programmed into a variety of handheld electronic games which duplicate the physical game. FIG. 16 shows a handheld electronic game 110 comprising a generally cubic base 111 having an array of 9 finger buttons such as 112 on each side. Selecting one of the buttons would be the equivalent of inserting a cube into the frame at that particular location in the mechanical game. The frame also comprises one or more display/input panels 114, disposed at the edges of the frame. The panels may display information such as the score, current player ID, active face, etc. The panel 114 may also comprise input means which allow the user to input data such as desired face and location of move, player ID, etc. The display may also include an electronic die for selecting the face for the next move at random. The electronic die comprises a numeric display which displays the numerals 1 through 6 in successive or random order, at a rate too fast for the human eye to track. An input device allows a player to halt the numeric display at an essentially random spot.

Figure 17:
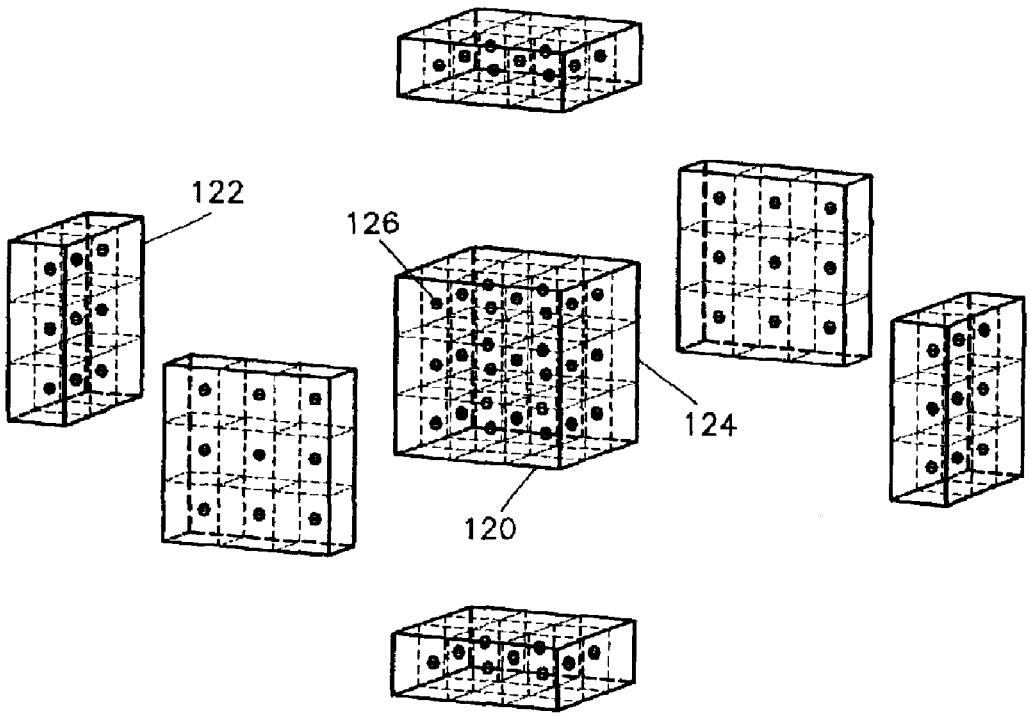
FIG. 17 shows an exploded isometric view of an alternative electronic version of the game comprising transparent cubes containing LEDs.
Figure 18:
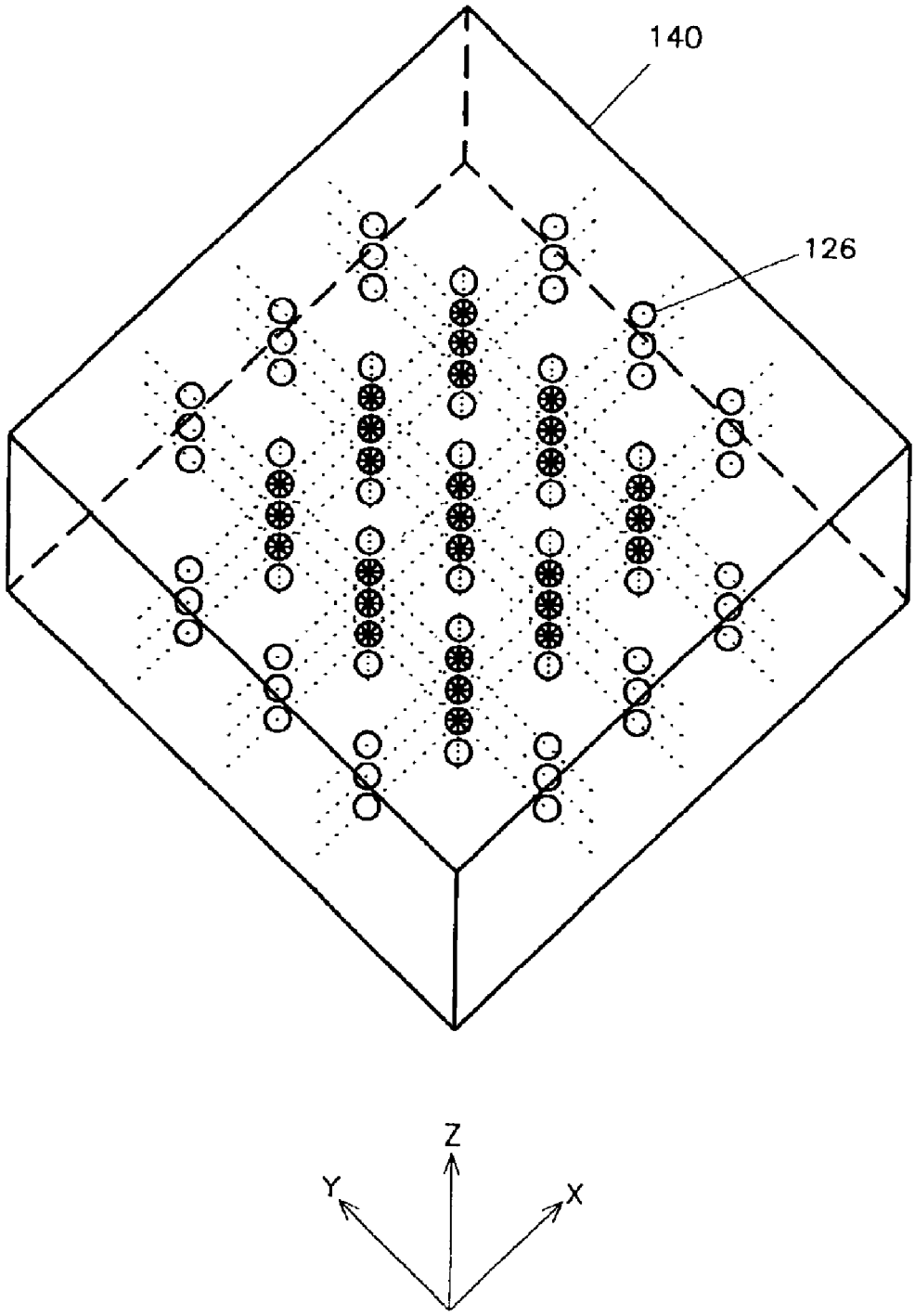
FIG. 18 shows an assembled isometric view of the LED array for the game shown in FIG. 17.

FIG. 18 shows another handheld electronic embodiment of the game comprising an essentially transparent cube 140 containing an array of LEDs or other electrically powered lighting devices 126. In FIG. 17 the LEDs are shown in exploded view to represent the center array 120 and the face arrays such as 122, as in the physical game. In other embodiments the actual game could be structured as shown in FIG. 17, with the face arrays separated from the center array for better visibility. The face arrays would be mounted in separate face frames and the center array would be mounted in a center frame. The game also comprises a lattice of wires 124 providing electricity to the LEDs. During play, the virtual location of the "scoring cubes" could be represented by providing power to the LEDs. The location of the lights would move through the game during play, representing movement of the cubes in the mechanical version of the game.

Figure 19:
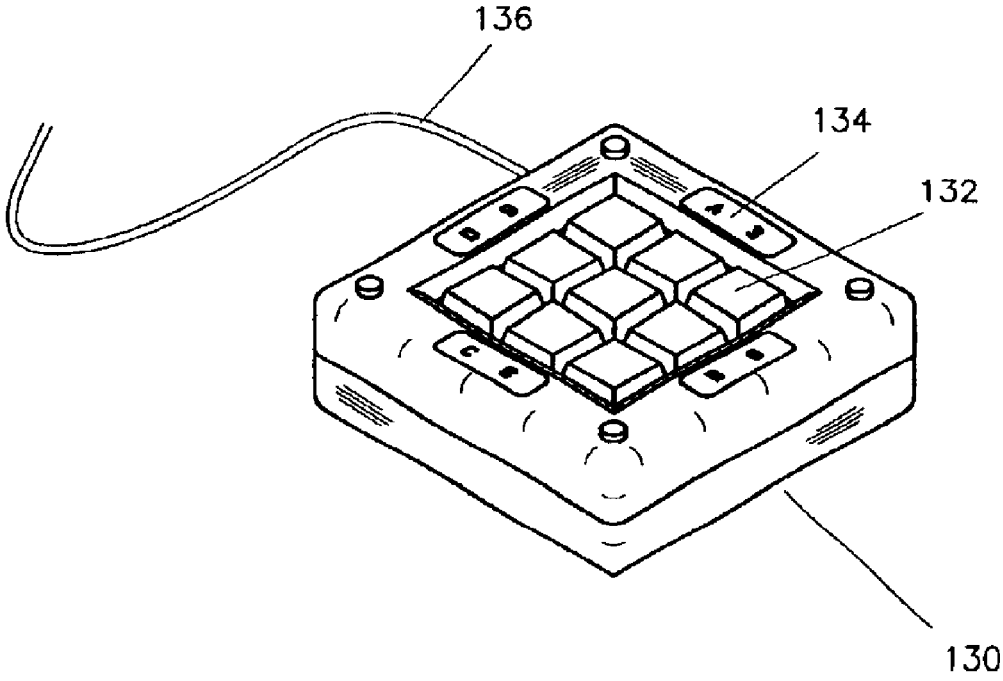
FIG. 19 shows a remote input and display device for use with the games shown in FIGS. 16 through 18.

The game of FIGS. 17 and 18 could also be provided with an array of buttons or other touch sensitive devices mounted on the sides of the game and corresponding to side arrays of the mechanical game. Selecting one of the buttons would be the equivalent of inserting a cube into the frame at that particular location. Any of the computer or electronic versions of the game may also include one or more remote input devices 130 as shown in FIG. 19. Device 130 can include a keypad 132 for use by the players to input data or select moves. Device 130 can also include one or more display panels 134 for displaying game or player information. Device 130 could be networked to the game and to other such devices through cable 136. In other embodiments, the keypad 132 and/or display 134 could be replaced by a touchscreen or similar device. Any of the computer or electronic versions of the game could also include sound effects for indicating various game conditions, end of turn, scoring, etc.

The electronic version of the game may also be modeled for play over the Internet or telephone. The game may be played as a spectator type game, where the spectators know the internal configuration of the game, but the players do not. The players may also be asked to answer trivia type questions corresponding to each move, or the scoring buttons could represent questions which must be answered before the score is awarded. All of the above electronic or physical versions of the game may include the electronic die. A time limit for moving may also be established for the electronic or physical embodiments of the game.

The game may be converted to a casino type game, where the value of the cubes represent cash prizes or bets by the players. In one casino version of the game, the bets of individual players could be provided with means for identifying which player initiated the bet. If a player receives his own bet back during his or her turn, he may be awarded a multiple of his original bet from the house. If a player receives another players bet, the receiving player would be awarded the face value of the bet. A time limit could be set for the overall game, after which time limit the house retains all un-awarded bets. The concept of placing "bets" which are identified with particular players, and the concept of awarding a multiple of the original bet to the original better, can also be applied to any of the physical or electronic versions of the game.

It should be recognized that, while the present invention has been described in relation to the preferred embodiments thereof, those skilled in the art may develop a wide variation of structural and operational details without departing from the principles of the invention.

What is claimed is:

1. A game apparatus comprising:

a) a first plurality of cubes each being approximately a particular unit length per side, said first plurality of cubes being arranged in a cubic center array having six square faces, each face being at least two of said unit lengths per side;

b) a second plurality of cubes each being approximately the same size as said first plurality of cubes, said second plurality of cubes being arranged in six square side arrays, each side array being approximately the same size as said square faces of said center array, each said side array being disposed proximate to one of said square faces;

c) at least one pilot cube of approximately the same size as said first and second pluralities of cubes;

d) a generally cubic frame for receiving said center array and said side arrays; and e) retention means for removably retaining said cubes in said frame such that as one of said cubes is inserted into said frame, another of said cubes is ejected from the corresponding position on the opposite side of said frame.

2. The game apparatus of claim 1 wherein said first plurality of cubes comprises exactly 27 cubes.

3. The game apparatus of claim 1 wherein said unit length is approximately 2 inches.

4. The game apparatus of claim 1 wherein the edges of said cubes are rounded or chamfered.

5. The game apparatus of claim 1 wherein at least one of said first plurality of cubes is a scoring cube having removable marking means thereon for marking the value of the scoring cube.

6. The game apparatus of claim 5 wherein said marking means comprises:

a) a recess in at least one side of said scoring cube; and b) a button removably installable in said recess.

7. The game apparatus of claim 6 wherein:

a) said recess includes an internal lip therein; and b) said button includes a plurality of resilient retaining tabs for releasably engaging said internal lip.

8. The game apparatus of claim 1 wherein said frame comprises 12 elongate legs, each leg having a generally square cross-section of approximately one unit length per side, said legs being rigidly attached to each other to form a frame cube defining a center volume for receiving said center array and 6 side volumes for receiving said side arrays.

9. The game apparatus of claim 8 wherein said retention means comprises a plurality of thin elastic cords attached to said frame, said elastic members being disposed across said side arrays generally at the interface between adjacent cubes in said side array.

10. The game apparatus of claim 9, further comprising a plurality of thin, generally cylindrical members rotatably mounted on said elastic cords.

11. The game apparatus of claim 8 wherein said retention means comprises at least one generally circular rotatable cover mounted on a face of said frame, said cover comprising a plurality of generally square openings therein, said openings being sized to allow passage of said cubes therethrough, said openings being arranged for selective alignment with the cubes in the side array corresponding to said face of said frame.

12. The game apparatus of claim 11 wherein said cover further comprises a plurality of teeth on its outer diameter, and said frame further comprises a detent means for resiliently retaining said cover in a particular angular position.

13. The game apparatus of claim 11 wherein said retention means comprises a plurality of said covers geared together for synchronous rotation.

14. The game apparatus of claim 1, further comprising a stand for rotatably supporting said frame.

15. A method of playing an insertion type game having a plurality of cubes configured for relative movement and arranged in a cubic center array and six side arrays, each side array disposed adjacent a side of said center array, at least one of said cubes in said center array being a scoring cube, and said cubes being releasably retained in a frame, wherein:

a) a first player inserts said pilot cube into a first of said side arrays, thereby ejecting a cube from the side array on the opposite side of said frame;

b) a second player inserts said ejected cube into one of said side arrays adjacent to said first side array;

c) each subsequent player inserts the previously ejected cube into any side array;

d) whenever a player ejects a scoring cube from said frame, the value of said scoring cube is added to said player's score, and said player removes said marking means from said scoring cube prior to insertion of said scoring cube into said frame by the next player; and e) the game is won by whichever player receives a majority of the total value of all said scoring cubes.

16. The method of play of claim 15, wherein each side array selected for insertion after step (b) is selected by the inserting player.

17. The method of play of claim 15, wherein each side array selected for insertion after step (b) is selected at random.

18. The method of play of claim 15, wherein at least one of said scoring cubes represents a bet placed by at least one of the players.

19. A computer model for modeling the method of play of claim 15, said model comprising:

a) a computer system comprising a central processor, a display device, and an input device;

b) a spreadsheet model configured to run on said computer system, said spreadsheet model comprising:

i. a plurality of play areas, each play area representing one of the side arrays, each play area comprising a plurality of pushbuttons selectable by said input device, each push button representing a cube in one of said side arrays, wherein selecting one of said pushbuttons in the spreadsheet model is equivalent to inserting a cube in the corresponding location in the side array of the game apparatus;

ii. a plurality of cell arrays representing sectional slices through the game apparatus, wherein the value within each cell represents the score value of the cube in the corresponding location in the game apparatus;

iii. at least two scoring cells for displaying the relative scores of the players;

iv. a plurality of program macros for manipulating the values in the cell arrays and the scoring cells, wherein the movement of values within the cell arrays duplicates the movement of the scoring cubes in the game apparatus.

20. The computer model of claim 19, wherein each play area comprises exactly 9 pushbuttons.

21. The computer model of claim 19 further comprising a reset pushbutton for resetting the model to a predetermined starting point.

22. An electronic device for modeling the method of play of claim 15, said device comprising:

a) a generally cubic frame;

b) a plurality of buttons arranged in at least one square array, each said array being disposed on a face of said frame;

c) at least one display/input device; and d) processing means programmed to simulate said method of play, said processing means communicating with said buttons and said display input panel, such that pushing one of said buttons on said device is equivalent to inserting a cube in the corresponding location in the side array of the game apparatus.

23. The electronic device of claim 22 comprising exactly 6 arrays of buttons, each array of buttons comprising exactly 9 buttons.

24. The electronic device of claim 22 wherein at least one of said display/input devices comprises a panel disposed on said frame.

25. The electronic device of claim 22 wherein at least one of said display/input devices is remote from said frame.

26. An electronic device for modeling the method of play of claim 15, said device comprising:

a) a first plurality of light emitting devices arranged in a generally cubic center array having six square faces;

b) a second plurality of light emitting devices arranged in six generally square side arrays, each said side array being approximately the same size as said square faces of said center array;

c) at least one display/input means for selection by the players of particular locations on said side arrays;

d) processing means programmed to simulate said method of play, said processing means communicating with said display/input means and with said light emitting devices to turn said light emitting devices on or off, such that selection of a location on one of said side arrays is equivalent to inserting a cube in the corresponding location in the side array of the game apparatus, and the state of the light emitting devices represents location of the scoring cubes in the game apparatus.

27. The electronic device of claim 26 wherein said side arrays are disposed proximate to said square faces of said center array.

28. The electronic device of claim 26 wherein said side arrays are disposed separately from said center array.

29. The electronic device of claim 26 wherein said display/input means comprises at least one array of buttons disposed on at least one of said side arrays.

30. The electronic device of claim 26 wherein said display/input means comprises at least one display/input device remote from said center array.

* * * * *